US007686310B2

(12) United States Patent
Perkins

(10) Patent No.: US 7,686,310 B2
(45) Date of Patent: Mar. 30, 2010

(54) ELEVATED WORK PLATFORM AND MULTI-FUNCTION TOOL

(75) Inventor: Mark Perkins, Calgary (CA)

(73) Assignee: Nomad Manufacturing & Distribution Ltd., Calgary (CA)

( * ) Notice: Subject to any disclaimer, the term of this patent is extended or adjusted under 35 U.S.C. 154(b) by 0 days.

(21) Appl. No.: 11/763,370

(22) Filed: Jun. 14, 2007

(65) Prior Publication Data

US 2008/0309034 A1 Dec. 18, 2008

(51) Int. Cl.
*B25H 5/00* (2006.01)

(52) U.S. Cl. ..... 280/32.6; 280/32.5

(58) Field of Classification Search ..... 280/32.6, 280/32.5, 62, 639
See application file for complete search history.

(56) References Cited

U.S. PATENT DOCUMENTS

| | | | | |
|---|---|---|---|---|
| 3,737,007 | A | 6/1973 | Herrell | |
| 4,118,010 | A * | 10/1978 | Hanscom | 254/124 |
| D271,717 | S | 12/1983 | Linn | |
| 4,895,380 | A | 1/1990 | Brooks et al. | |
| 5,080,381 | A * | 1/1992 | Perez | 280/35 |
| 5,297,809 | A | 3/1994 | Chen | |
| 5,419,945 | A | 5/1995 | Lopez | |
| 5,460,392 | A * | 10/1995 | Hansen | 280/32.6 |
| 5,553,991 | A * | 9/1996 | Ferreira | 414/680 |
| 5,895,062 | A * | 4/1999 | Miles et al. | 280/32.6 |
| 5,897,100 | A * | 4/1999 | Napier et al. | 254/8 B |
| 5,934,490 | A * | 8/1999 | Mora | 212/176 |
| 5,947,489 | A | 9/1999 | Tucker | |
| 6,059,298 | A | 5/2000 | Tucker | |
| 6,095,532 | A * | 8/2000 | Martin | 280/32.6 |
| 6,199,877 | B1 | 3/2001 | Shockley | |
| 6,238,069 | B1 | 5/2001 | Miles | |
| 6,641,146 | B2 * | 11/2003 | Reese | 280/32.6 |
| 6,824,149 | B1 * | 11/2004 | Whitlock et al. | 280/32.6 |

(Continued)

FOREIGN PATENT DOCUMENTS

| | | |
|---|---|---|
| CA | 2534153 | 7/2006 |

(Continued)

OTHER PUBLICATIONS

Auto Body Toolmart, "4020 Overhead Creeper".

(Continued)

*Primary Examiner*—Kevin Hurley
*Assistant Examiner*—Tashiana Adams
(74) *Attorney, Agent, or Firm*—Dennis R. Haszko; Eaton Peabody Patent Group, LLC

(57) ABSTRACT

This invention pertains to a multi-function tool that when assembled in different configurations would meet many needs of the home or commercial mechanic. One configuration is height adjustable allowing users to work safely in an elevated position over the engine compartment of a light truck (i.e. half-ton to one-ton vehicle) even if that vehicle is lifted or taller than factory normal. Another configuration is an engine stand to hold a small engine block so the mechanic may repair it. Yet another configuration is a crane or hoist to assist in lifting engines or parts of engines (e.g. heads) out of the engine compartment to prevent injury to the mechanic. This hoist could also aid in lifting the engine or engine parts onto the engine stand or onto another conveyance (i.e. onto a truck).

8 Claims, 8 Drawing Sheets

U.S. PATENT DOCUMENTS

| | | | | |
|---|---|---|---|---|
| 7,032,908 | B2 * | 4/2006 | Melvin | 280/32.6 |
| 7,070,189 | B2 | 7/2006 | Grauss | |
| 2003/0098559 | A1 * | 5/2003 | Reese | 280/32.6 |
| 2007/0241523 | A1 * | 10/2007 | Lewman | 280/32.5 |

FOREIGN PATENT DOCUMENTS

| | | |
|---|---|---|
| CA | 2508191 | 10/2006 |

OTHER PUBLICATIONS

Automotive Specialty Tools, Inc., "Overhead Creeper—TL72300", Feb. 12, 2007. URL<http://www.etoolcart.com/browseproducts/Overhead-Creeper—TL72300.HTML>.

Quadratec, Inc., "Topside Creeper Adjustable Overhead Creeper", Feb. 12, 2007. URL<http://www.quadratec.com/products/92810_140.htm>.

4TEK LLC, "Kreepster, the Creeper of the Future", URLhttp://www.kreepster.com/index.html; "Creepstool, the perfect companion to the Kreepster", Feb. 6, 2007. URL <http://www.kreepster.com/index.html>.

APO Australian Parts Online "Topside Creeper", Jan. 31, 2007. URL<http://www.apo.com.au/creeper.html>.

Tech-Lift, "Topside Creeper", Jan. 31, 2007. URL<http://www.agrabilityproject.org/search/showpic.cfm?picname=Techlift.jpg&product=Topside Creeper>.

* cited by examiner

ELEVATED WORK PLATFORM AND MULTI-FUNCTION TOOL

FIELD OF THE INVENTION

The present invention relates to support platforms, commonly referred to as a mechanic's "creeper". More particularly, the present invention relates to an elevated creeper which also provides a multi-function work stand, crane, or hoist or a combination of these.

BACKGROUND OF THE INVENTION

Creepers help mechanics and others work under, around, or even above vehicles.

U.S. Pat. No. 6,199,877 (Shockley) is directed to a transformable mechanic's creeper having a base assembly and a seat assembly, in pivotal connection. With the base assembly and the seat assembly positioned in general horizontal alignment, a creeper position is defined. With the base assembly and the seat assembly in general vertical alignment, a seating position is defined.

There have been a number of patents directed to inventions that attempt to solve the problems of reaching elevated or awkwardly situated vehicle components, for example the top or back of an engine of a truck.

U.S. Des. Pat. No. D271,717 (Linn) is directed to an ornamental design for an elevated creeper for automotive mechanics.

U.S. Pat. No. 6,641,146 (Reese) is directed to a creeper with an elevated platform. A chest board is pivotable with respect to a body board to provide comfort and accessibility to the work area. The creeper of Reese is preferably sold in combination with or as an add-on conversion for an engine hoist commonly know as a "cherry picker".

There are a wide variety of devices, tools, work stands, cranes, hoists, and support structures which may assist a person in accessing, maintaining, or repairing vehicle components. However, due to the practicalities of cost and physical space, not every mechanic or every shop can have every piece of equipment.

It is, therefore, desirable to provide an elevated creeper which also provides a multi-function work stand, crane, or hoist or a combination of these.

SUMMARY OF THE INVENTION

It is an object of the present invention to obviate or mitigate at least one disadvantage of previous elevated work platforms.

In a first aspect, the present invention provides a multi-function platform creeper having a base, a fixed mast member having an upper section and a lower section, the lower section connected to the base, and the mast member adapted to receive a tool section.

Preferably, the multi-function platform creeper includes a standing platform on the base. The tool section may include an elevated work platform, the platform having a body section, a leg section, the leg section pivotable between a non-working position and a working position, and locking means for selectively locking the leg section in the working position.

The tool section may be a crane, a hoist, an engine mount, or a combination, such as an engine mount and a crane or an engine mount and a hoist.

In a further aspect, the present invention provides an elevated platform creeper having a base, a mast member having an upper section and a lower section, the lower section connected to the base, and an elevated work platform connected to the mast, the elevated work platform having a body section, a leg section, the leg section pivotable between a non-working position and a working position, and locking means for selectively locking the leg section in the working position.

Preferably, the base includes a standing platform. Preferably, the mast includes a tube. Preferably, the tube is adapted to receive a tool section within the tube. Preferably the body section is cantilevered. Preferably, the leg section is cantilevered. Preferably, the leg section is substantially horizontal when in the working position. Preferably, the mast and the standing platform are connected.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a method and apparatus for servicing vehicles, particularly the engine compartment of vehicles.

Figure 1:
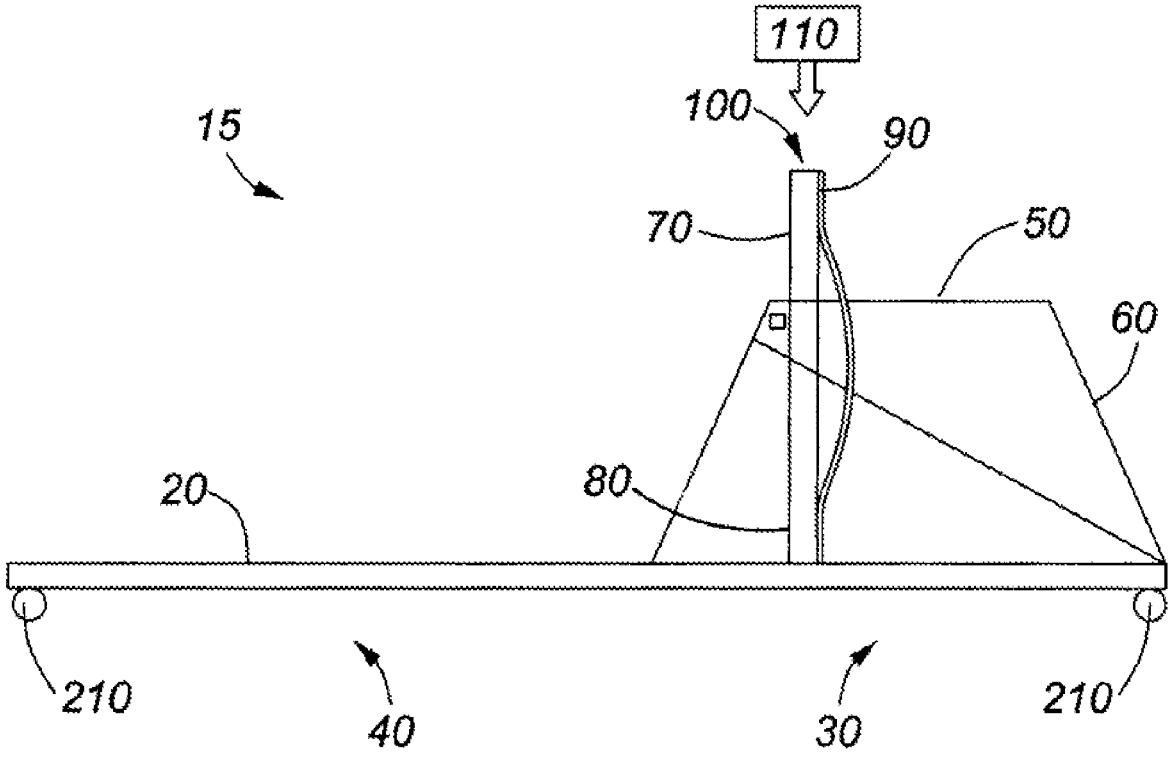
FIG. 1 is a simplified schematic of a multi-function base of the present invention.

Referring to FIG. 1, a multi-function platform creeper 10 of the present invention includes a base section 15. An elongate multi-function base 20, having a working end 30 and a free end 40. The free end 40 adapted to extend beneath a vehicle, to allow the working end 30 to be moved in closer proximity to the vehicle.

A standing platform 50 rests on the multi-function base 20. Depending on the height of the standing platform 50, one or more steps 60 provide a safe ascent/descent to the standing platform. Handrails (not shown) may also be included.

A vertical member in the form of a mast member 70 protrudes from the multi-function base 20. A lower section 80 of the mast member 70 is attached to the multi-function base 20, for example by bolting, welding, or other attachment means. An upper section 90 of the mast member 70 has a connector 100 for receiving a tool section 110. While the lower section 80 is shown attached to the multi-function base 20, one skilled in the art would recognize that the lower section 80 may be attached to the standing platform 50, or both.

Figure 2:
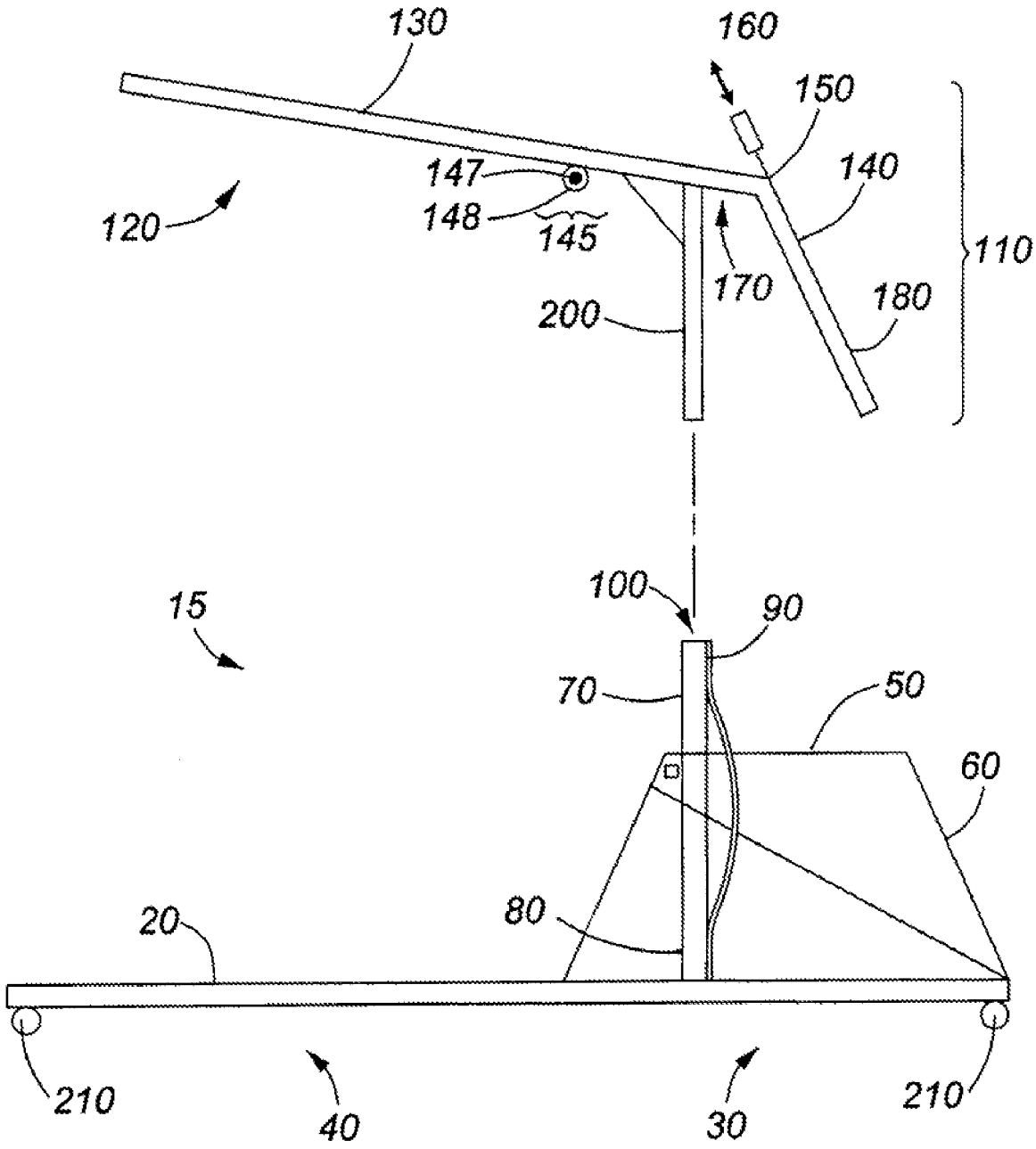
FIG. 2 is the multi-function base of FIG. 1, with a simplified schematic of an elevated work platform of the present invention (pre-assembly)
Figure 3:
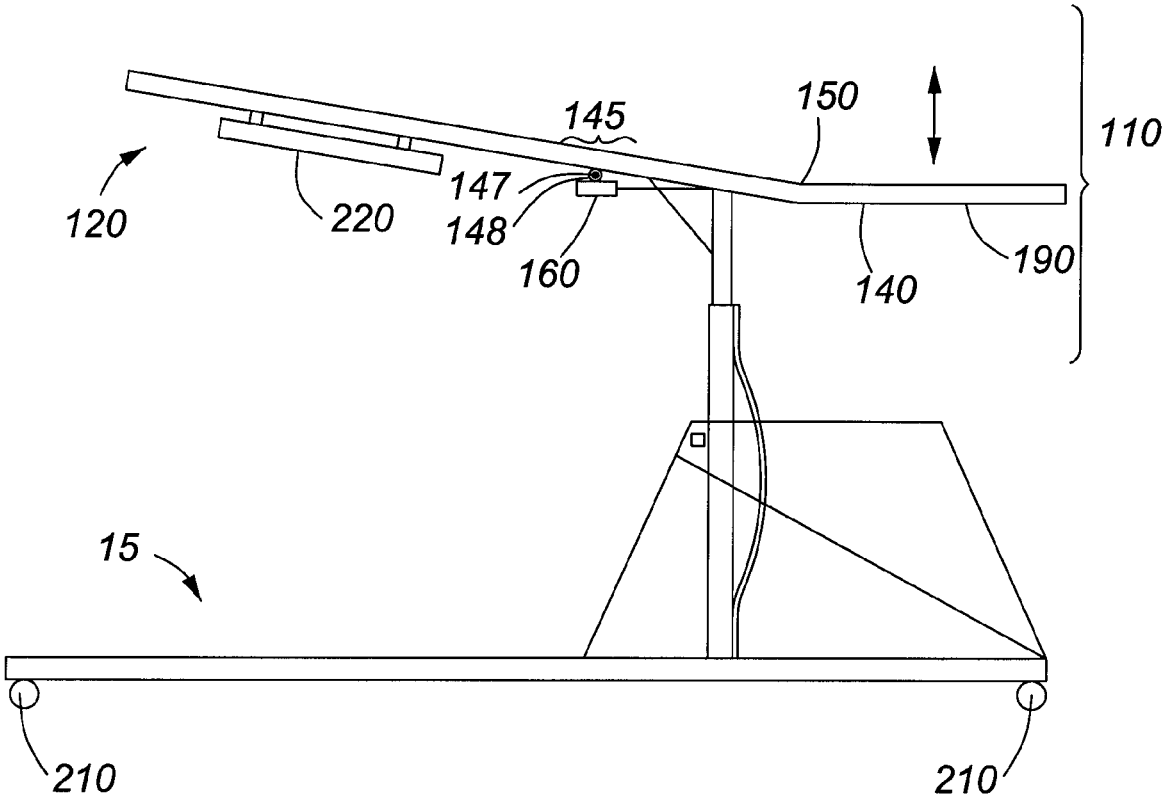
FIG. 3 is the multi-function base and elevated work platform of FIG. 2 (assembled) with leg section in working position.
Figure 4:
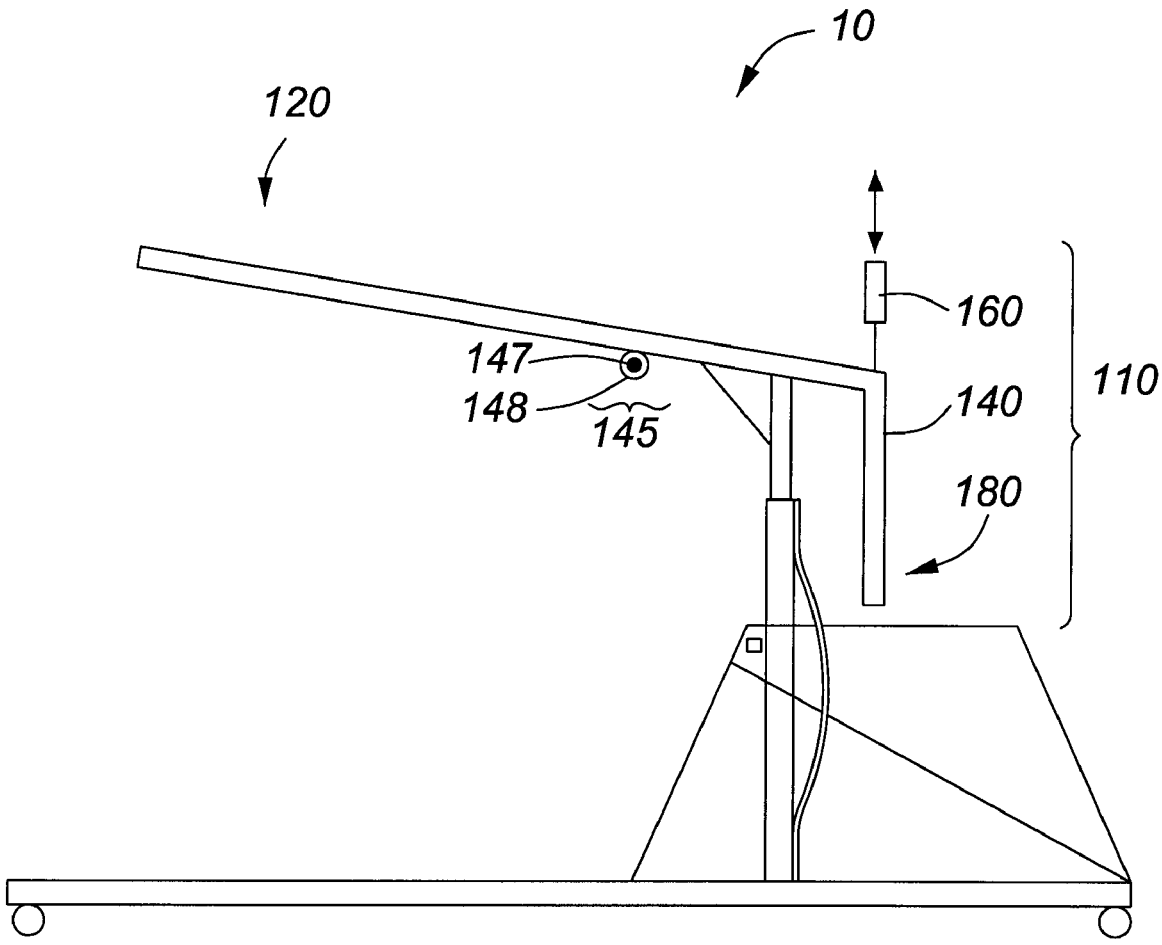
FIG. 4 is the multi-function base and elevated work platform of FIG. 2 (assembled) with leg section in non-working position.

Referring to FIGS. 2-4, the base section 15 is shown receiving a tool section 110, in this case, an elevated work platform 120. The elevated work platform 120 is received by the mast member 70.

The elevated work platform 120 includes a body section 130 and a leg section 140. The body section 130 is fixed in a generally horizontal position. The angle of the body section 130 is preferably between about −15° (15° downward) and about +15° (15° upward). However, one skilled in the art will appreciate that a wide variety of angles are included in the present invention, to suit a wide variety of operating conditions. The body section 130 and/or the leg section 140 may be padded to increase comfort.

The elevated work platform 120 may be height adjustable. The member 200 of the elevated work platform 120 and the mast member 70 of the base section 15 may be selectively vertically adjustable. For example, as shown, the member 200 may be received in the mast member 70 and fixed in place. Because member 200 as shown is received and selectively adjustable within the mast member 70, it should be readily apparent to one of ordinary skill in the mechanical art that the member 200 is considered telescopically received in the mast member 70. It is known that the term telescoping in mechanics describes the movement of one part sliding out from another, lengthening or shortening an object from one position to another. The elevation of the elevated work platform 120 may be selected by the degree that the member 200 is received in the mast member 70 prior to fixing the member 200 in place.

The leg section 140 is selectively pivotable about pivot 150 between a non-working position 180 (FIG. 4) and a working position 190 (FIG. 3). The non-working position 180 describes the leg section 140 when it is pivoted down, out of the working position 190. The leg section 140 may be locked into the working position 190 through the selective use of locking means 170. A lever or handle 160 may be used to allow the user to move the leg section 140 between the non-working position 180 and the working position 190, and/or to activate the locking means 170.

Preferably, the lever or handle 160 is axially extendable from the leg section 140. The lever or handle 160 may extend from the leg section 140 to engage a stop 145 to form a locking means 170 to lock the leg section 140 in the working position 190. The stop 145 may extend or be extendible from the side of the elevated work platform 120, and the lever or handle 160 may extend to engage the underside of the stop 145, thereby locking the leg section 140 into the working position 190. The stop 145 is preferably a shaft 147 slidably received in a guide, preferably in the form of a tube 148, the tube 148 extending laterally across the elevated work platform 120. Preferably, to lock the leg section 140 into the working position 190, the lever or handle 160 is extended and the shaft 147 is extended (within tube 148) such that there is engagement between the shaft 147 and the lever or handle 160 (with the shaft 147 below the lever or handle 160) such that the leg section 140 is held in the working position 190.

A plurality of wheels and/or casters 210 may be provided to facilitate movement of the multi-function platform creeper 10, either when being used or not being used. A tool tray 220 as shown in FIG. 3 may be provided proximate the body section 130 to keep parts and tools organized as well as keeping these items from falling from the elevated work platform 120. The tool tray 220 may be a relatively flat or concave tray having an outer perimeter lip to retain tools.

Figure 5:
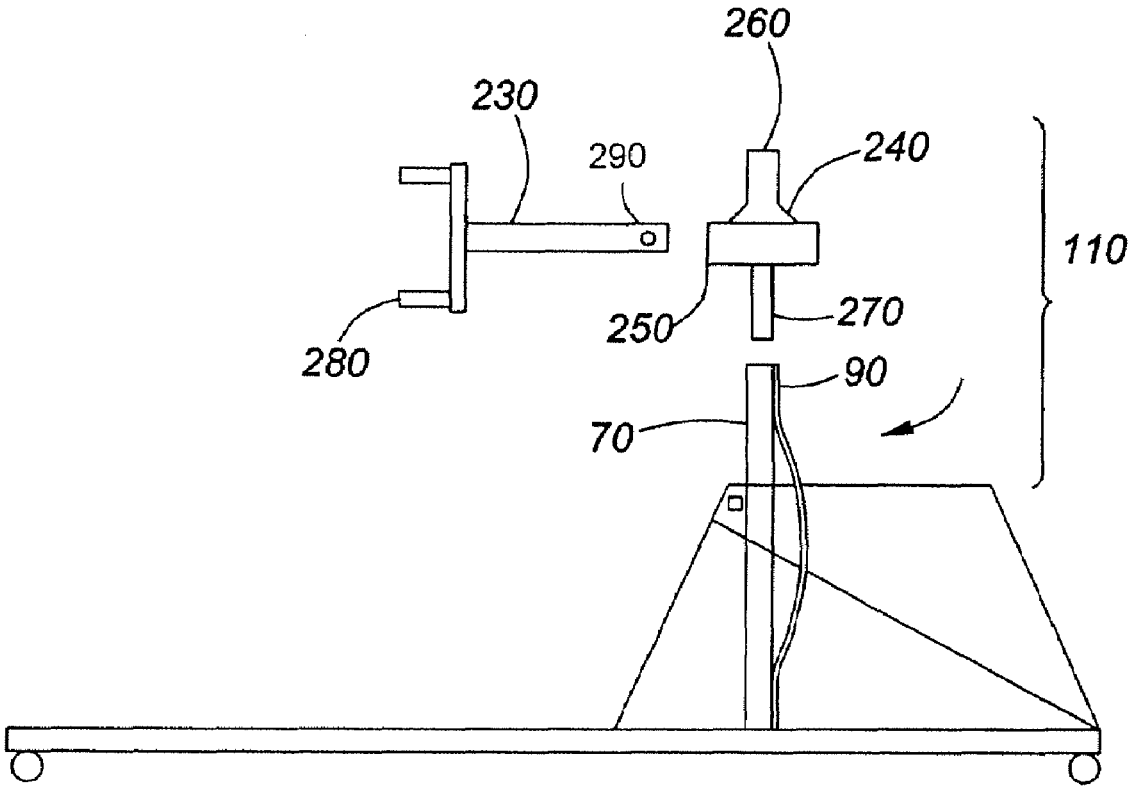
FIG. 5 is the multi-function base of FIG. 1, with a multi-head and an engine mount of the present invention (pre-assembly)
Figure 6:
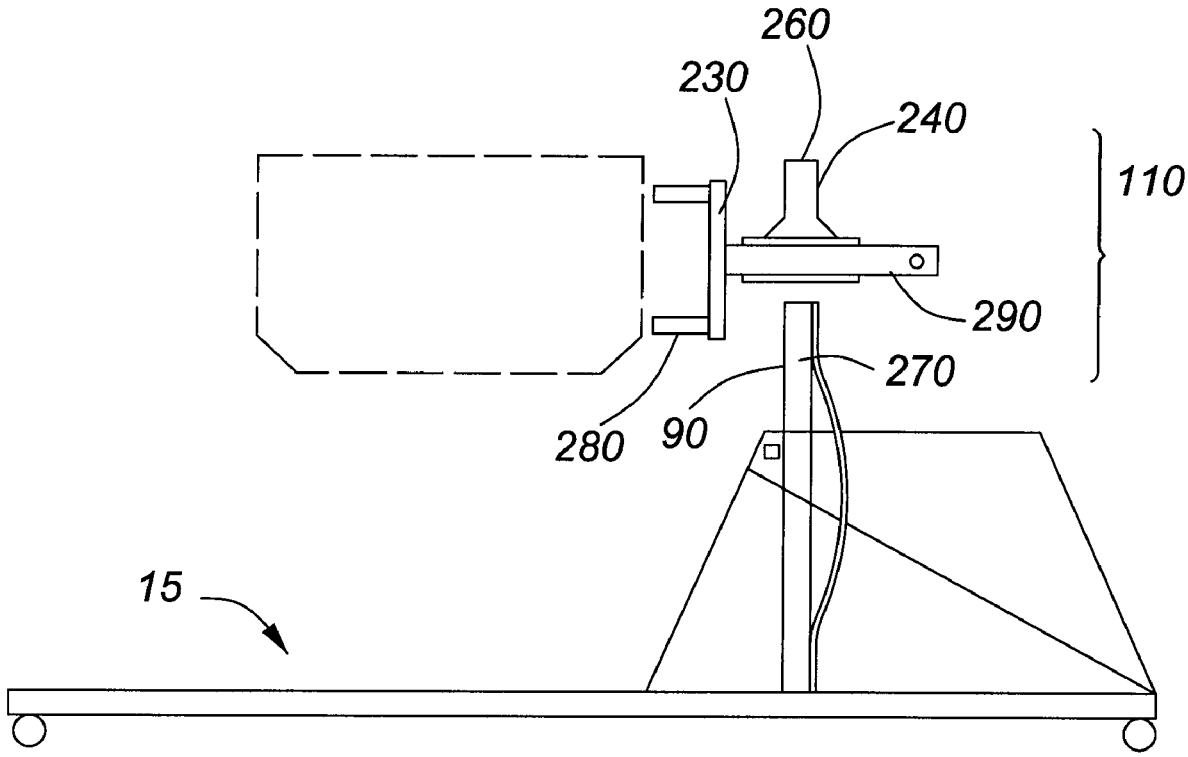
FIG. 6 is the multi-function base, the multi-function utility head, and the engine mount of the present invention (assembled)

Referring to FIGS. 5-6 the base section 15 is shown receiving a tool section 110, in this case, an engine mount 230 associated with a multi-head 240. The multi-head 240 is received by the mast member 70 and the engine mount 230 is received by the multi-head 240. As shown, a shaft 270 of the multi-head 240 is inserted into the upper section 90 of the mast member 70. The engine mount 230 has a plurality of connectors 280 adapted to connect with an engine or other automotive component, and a shaft 290 which is received into an opening 250 in the multi-head 240. An additional opening 260 is available for connecting to or receiving other devices. When an engine is mounted to connectors 280, an operator is provided with a convenient means of working on all sides of the engine.

Figure 7:
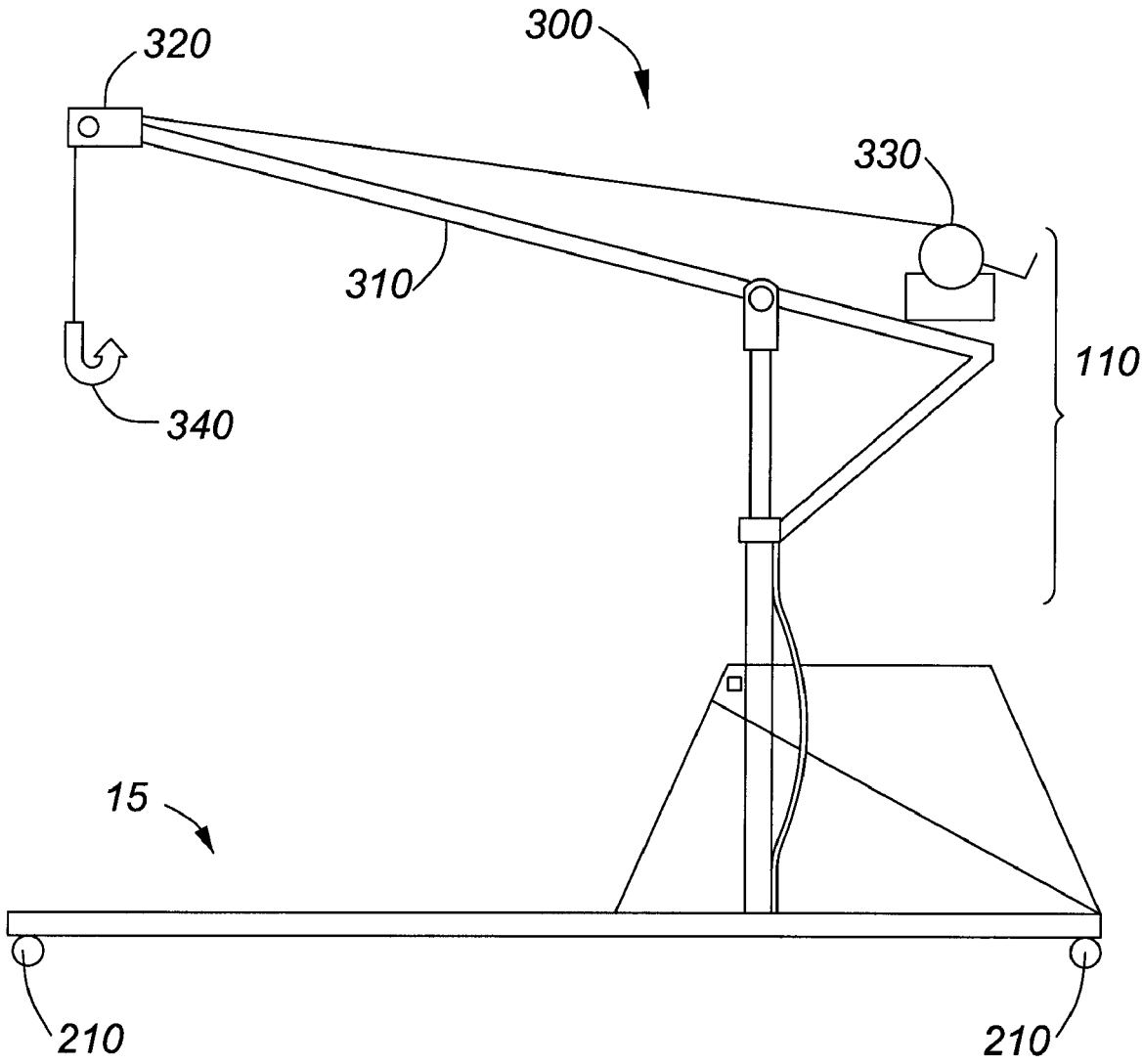
FIG. 7 is the multi-function base of FIG. 1, with a crane.

Referring to FIG. 7, the base section 15 is shown receiving a tool section 110, in this case, a crane 300. The crane 300 has an elongate boom 310, a pully system 320, a hoisting means 330, and a hook 340. While shown as a manual hoist, the hoisting means 330 may be powered (not shown), for example by electricity, pneumatic (e.g. air), or otherwise.

Figure 8:
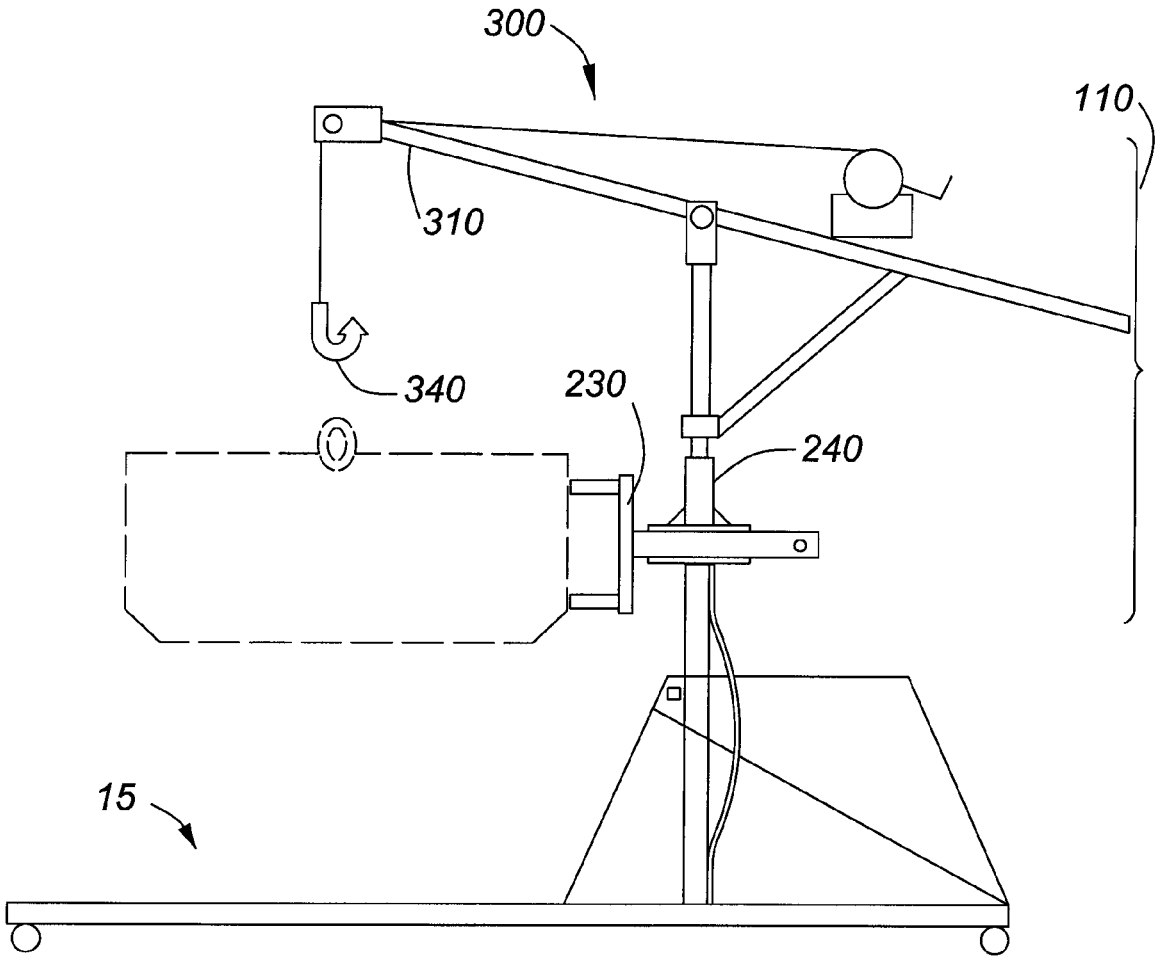
FIG. 8 is the multi-function base of FIG. 1, a multi-head, an engine mount, and a crane.

Referring to FIG. 8, the base section 15 is shown receiving a tool section 110, in this case, a crane 300 and an engine mount 230, both received in the multi-head 240. The boom 310 has been adjusted to allow the hook 340 to be generally aligned with an engine (shown in outline).

In operation, the operator may select a tool section 110, for example an elevated work platform 120 and attach it to the base section 15 to form a multi-function platform creeper 10. The operator may select the elevation of the elevated work platform 120 by adjustment relative to the base section 15. The multi-function platform creeper 10 is then positioned as desired, for example, to work on a vehicle. The operator may climb onto the standing platform 50 and bend forward and reach as desired to perform a wide variety of tasks. If the operator wishes to lay forward, the operator can rest upon the body section 130 while continuing to stand on the standing platform 50.

To accommodate working bent over in a face down position, the operator may move the leg section 140 from the non-working position 180 into the working position 190 and lock the leg section 140 into the working position 190 by locking means 170. This reduces strain to the operator's knees and/or back, allowing the operator to work longer and more comfortably. When the operator wishes, the operator can release the locking means 170 and allow the leg section 140 to move back into the non-working position 180, and step down from the standing platform 50.

Referring to FIG. 3, the leg section 140 in the working position 190 forms an angle 380 relative to the body section 130. The angle 380 is preferably in the range between about 135 degrees and about 225 degrees. More preferably, the angle 380 is in the range between 180+/−15 degrees. Preferably, the angle 380 is less than or equal to 180 degrees to accommodate working in the face down position. Preferably, the angle 380 is greater than or equal to 180 degrees to accommodate working in a face up position. Preferably, the angle 380 is selectable between 0 and 360 degrees.

When not being used as a creeper, the base section 15, having mast member 70, is capable of receiving one or more tool sections 110 as described above, thereby adding to the versatility of the multi-function platform creeper 10.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. An elevated platform creeper comprising:

a. a base oriented horizontally;

b. a mast member, the mast member being immovably affixed directly upon the base and fixedly arranged perpendicular to the base such that the mast member is permanently oriented in an upright and vertical position, the mast member having an upper section configured to receive a movable member in a selectively vertically adjustable manner and a lower section contiguous along a single axis with the upper section, the lower section permanently affixed directly to the base; and c. an elevated work platform connected to the movable member and supported in its entirety by the movable member, the movable member of the elevated work platform being telescopically received within the upper section of the mast member such that the elevated work platform is selectively adjustable in a vertical direction relative to the mast member, the elevated work platform having:

i. a body section, fixed relative to the mast member, the body section having a first end and a second end each located at opposite ends of the body section from one another, the body section including a tool tray located proximate to the first end for enabling upper body access of the tool tray by a user of the elevated platform creeper;

ii. a leg section pivotably connected directly to the second end of the body section, the leg section pivotable between a non-working position and a working position, the non-working position being a drop angle downward, relative to the working position, the leg section in the working position forming lower body support for the user of the elevated platform creeper; and iii. locking means for selectively locking the leg section in the working position, such that a contiguous surface is completely formed by the body section and the leg section in the working position upon which contiguous surface the user of the elevated platform creeper is fully supportable.

2. The elevated platform creeper of claim 1, the base having a standing platform.

3. The elevated platform creeper of claim 2, wherein the leg section is substantially horizontal when in the working position.

4. The elevated platform creeper of claim 2, wherein the leg section is substantially vertical in the non-working position.

5. The elevated platform creeper of claim 2, wherein the body section is substantially horizontal.

6. The elevated platform creeper of claim 2, wherein the body section forms an angle between about −15 degrees and about +15 degrees relative to horizontal.

7. The elevated platform creeper of claim 2, wherein the leg section drops into the non-working position when released from the working position.

8. The elevated platform creeper of claim 2, wherein the non-working position is about 90 degrees downward relative to the working position.

* * * * *